United States Patent [19]

Lang

[11] Patent Number: 4,765,096

[45] Date of Patent: Aug. 23, 1988

[54] HONING DEVICE

[75] Inventor: Walter Lang, Fellbach, Fed. Rep. of Germany

[73] Assignee: Maschinenfabrik Gehring Gesellschaft mit beschrankter Haftung & Co. Kommanditgesellschaft, Ostfildern, Fed. Rep. of Germany

[21] Appl. No.: 22,698

[22] Filed: Mar. 6, 1987

[30] Foreign Application Priority Data

Mar. 7, 1986 [DE] Fed. Rep. of Germany ..... 3607580

[51] Int. Cl.[4] ..... B24B 5/40; B24B 55/02

[52] U.S. Cl. ..... 51/34 R; 51/266

[58] Field of Search ..... 51/34 R, 338, 345, 322, 51/213, 266, 267; 408/57, 59

[56] References Cited

U.S. PATENT DOCUMENTS 3,229,427 1/1966 Goodhew ..... 51/267

4,423,567 1/1984 Raven ..... 51/34 R

FOREIGN PATENT DOCUMENTS

G8325104.9 1/1984 Fed. Rep. of Germany .

493949 of 1938 United Kingdom ..... 51/338

*Primary Examiner*—Frederick R. Schmidt

*Assistant Examiner*—Bradley I. Vaught

*Attorney, Agent, or Firm*—Foley & Lardner, Schwartz, Jeffery, Schwaab, Mack, Blumenthal & Evans

[57] ABSTRACT

A honing device has a honing tool for the precision machining of blind-hole bores in a workpiece. The honing tool has a shank, at the free end of which honing strips are arranged. They can be moved radially outwards by means of a spreader rod. In a coolant duct system in the tool, during the machining of the workpiece coolant is supplied to the end of the honing tool facing the workpiece. To return the coolant, there are return ducts which extend along the outer periphery of the honing tool. The honing device also has a coolant feed device which can be aligned with and fixed to the honing tool. The feed and return of the coolant guarantee a precisely defined coolant circulation within the network zone.

19 Claims, 2 Drawing Sheets

HONING DEVICE

BACKGROUND OF THE INVENTION

The present invention relates to a honing device for the precision boring of small bores into workpieces.

In honing devices of this type, reference being made to Federal Republic of Germany Utility Model No. 83251049, for example, it is already known to feed the coolant in a controlled way into the work zone of the honing tool. There is an axial coolant duct which opens out directly into the work zone via radial bores. The coolant is fed via a coolant distributor arranged above a clamping point of the tool body. It is guided on a connecting tool attached to the honing tool and is held so as to be axially immovable. The connecting tool has a further clamping end which is located opposite the clamping end of the honing tool and which can be clamped in a drill chuck or the like of a machine tool.

The disadvantage of this known honing devices is that it has a relatively large overall length between the clamping end of the tool spindle and the work zone. Consequently, the shank of the honing tool tends to skew and vibrate during machining when its work zone enters the bore in the conventional gimbal-mounted workpiece, and this impairs the machining accuracy and the service life of the honing tool. Furthermore, the flushing of the work zone at the bottom of the blind-hole bore is unsatisfactory, since, in flow terms, dead areas can occur here. For high precision machining it is essential that the abraded particles be flushed away from the machining zone immediately.

The object of the present invention is to avoid these disadvantages and provide a honing device for precision machining, by means of which relatively small bores, especially blind-hole bores, can be machined to an unusually high accuracy not attainable hitherto by honing, while at the same time ensuring that the tool has a long service life.

The coolant feed device according to the invention can be arranged immediately above the workpiece on a device plate. The honing tool can pass centrally through the coolant feed device, and the latter can receive guide and sealing elements which can come freely into alignment with the shank of the honing tool. During honing, the guide and sealing elements are then held in the aligned position by means of the coolant pressure. This ensures an extremely rigid and vibration-free guidance of the honing tool. The feeding of the coolant under high pressure inside the honing tool to the front end of the honing tool facing the workpiece bore and the return of the coolant via the return channel guarantee a precisely defined coolant circulation within the work zone. As a result, machining accuracy is improved considerably by means of the honing device according to the present invention, so that the device is particularly suitable for making blind-hole bores which have to be machined with high precision, such as, for example, the machining of bores in injection-pump parts.

Further features of the invention will be apparent from the description which follows.

BRIEF DESCRIPTION OF THE DRAWINGS

The invention is described in detail below with reference to an exemplary embodiment shown diagrammatically and on an enlarged scale in the drawings. In these.

DETAILED DESCRIPTION OF THE PREFERRED EMBODIMENTS

Figure 1:
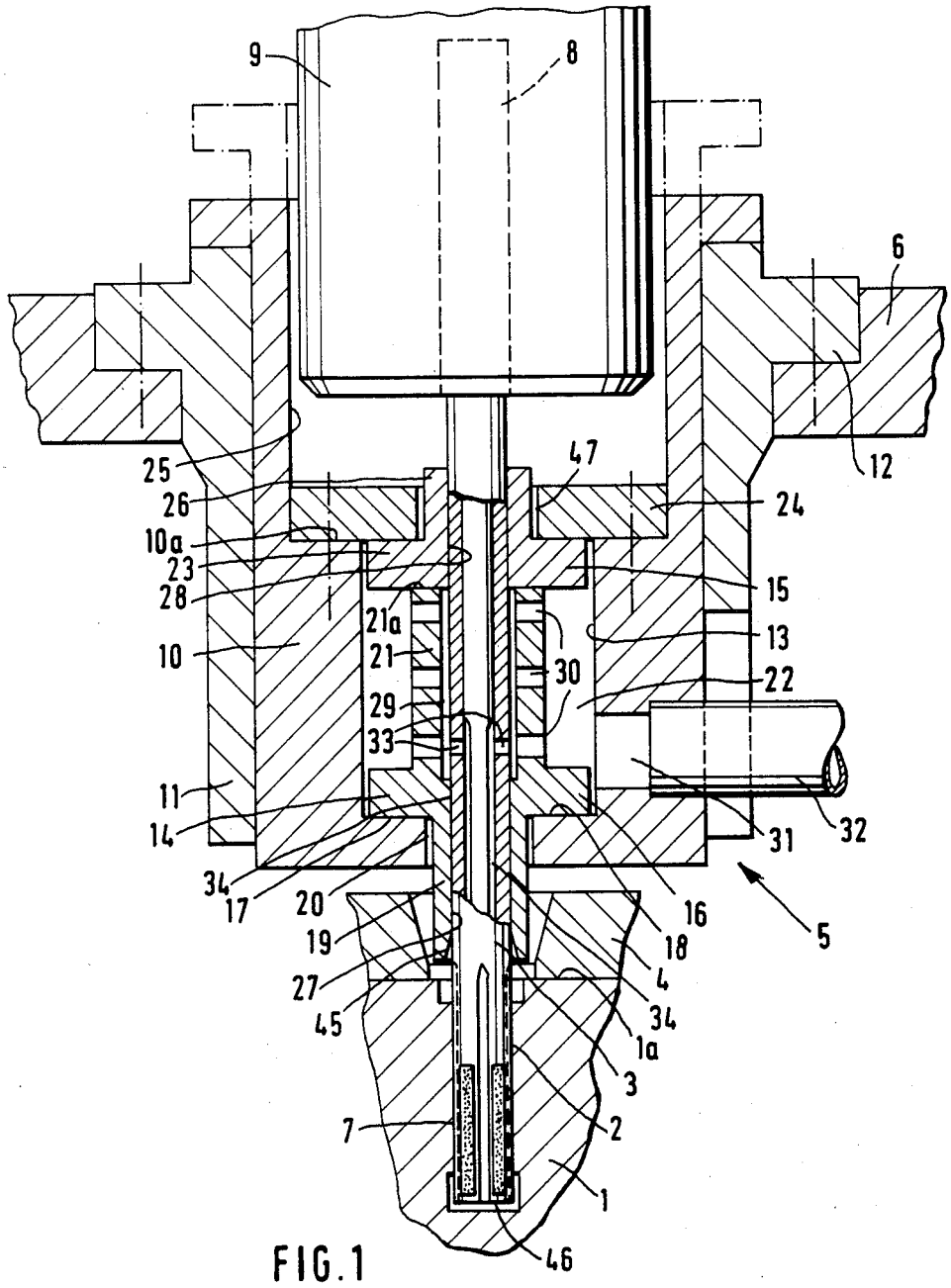
FIG. 1 shows a honing device according to the invention in axial section.

FIG. 1 illustrates a workpiece 1 with a blindhole bore 2 which is machined by a honing tool 3 of a honing device. For this purpose, the workpiece 1 is received and held in a known gimbal-type workpiece holder 4 (not shown in detail). Immediately above the workpiece holder 4 or the work zone, a coolant feed device 5 is so arranged on a device plate 6 fixed to the machine that a shank of the honing tool 3 passes centrally through it.

A clamping end 8 of the honing tool 3, located opposite the workpiece holder 4 of the honing tool 3 and arranged on the other side of the coolant feed device 5, is connected firmly to a machine spindle 9 by known means, for example, a collet (not shown).

A housing part 10, designed essentially as a hollow cylinder, of the coolant feed device 5 is guided so as to be axially displaceable in a guide bush 11. The latter is connected firmly to the device plate 6, for example, by means of a fitting flange 12, coaxially relative to the honing tool 3. The housing part 10 receives coaxially in a cylindrical bore 13 a guide part 14 of stepped outside diameter and an annular sealing part 15 adjoining the guide part in the axial direction. The guide part 14 has a center portion 16 which is widened in a flange-like manner and the outside diameter of which is somewhat less than the diameter of the cylindrical bore 13 of the housing part 10. The guide part 14 rests by means of a lower end face 17 on a bottom 18 of the housing part 10, this bottom 18 being formed by a step-like shoulder. An end portion 19 of narrowed diameter adjoins the center portion 16 downwardly and projects outwardly through a bore 20 in the bottom of the housing part 10. The bore 20 has a smaller width than the adjacent cylindrical bore 13. The narrowed portion 19 of the guide part 14 projects through the bore 20 with a relatively large amount of play. Joined to the center portion 16 at the top is an end portion 21. Its outside diameter is substantially less than the clear width of the cylindrical bore 13, but slightly greater than the outside diameter of the end portion 19. An annular chamber 22 for receiving coolant is formed between the wall of the cylindrical bore 13 and the outside of the end portion 21.

The annular chamber 22 is limited in the direction of the machine spindle 9 by the sealing part 15 which rests free of play against the end face **21*a* of the end portion 21 by means of a flange-like widened portion 23. The outside diameter of the portion 23 is somewhat less than the inside diameter of the cylindrical bore 13. The bore 13 is closed in the direction of the machine spindle 9 by means of a cover 24 which is fastened to a shoulder 10*a* of a widened bore portion 25 adjacent to and above the cylindrical bore 13 and located in the housing part 10. The ratios here are such that the guide part 14 and the sealing part 15 are held within the cylindrical bore 13 so as to be axially immovable but so as to float in the radial direction. The cover 24 has a passage bore 47 which extends coaxially relative to the cylindrical bore 13 and through which an end portion 26 of reduced diameter of the sealing part 15** passes with a relatively large amount of play.

The guide part 14 and the sealing part 15 have concentric passage bores 27 and 28, through which the tool shank 35 passes with slight play, with the bores having a guide and sealing function, as will be explained. The bore 27 widens in the region of the end portion 21 of the guide part 14 and forms a distributor chamber 29 surrounding the shank of the honing tool in this region, the chamber 29 serving to feed the coolant. Chamber 29 is in conductive communication with the annular chamber 22 via several sets of radial bores 30 arranged axially above one another in the end portion 21. In the exemplary embodiment, there are three sets of bores 30 which are each at an equal axial distance from one another. The bores 30 of a set are preferably at equal peripheral distances from one another.

The annular chamber 22 communicates with a coolant pressure source (not shown) via a connecting bore 31 and a line 32. In the region of the distributor chamber 29, there are radial bores 33 which are located diametrically opposite one another in the shank 35 of the honing tool and which lead to coolant ducts 34 inside the honing tool. The bores 33 are arranged in a corresponding way to the bores 30, preferably at equal peripheral distances from one another.

Figure 2:
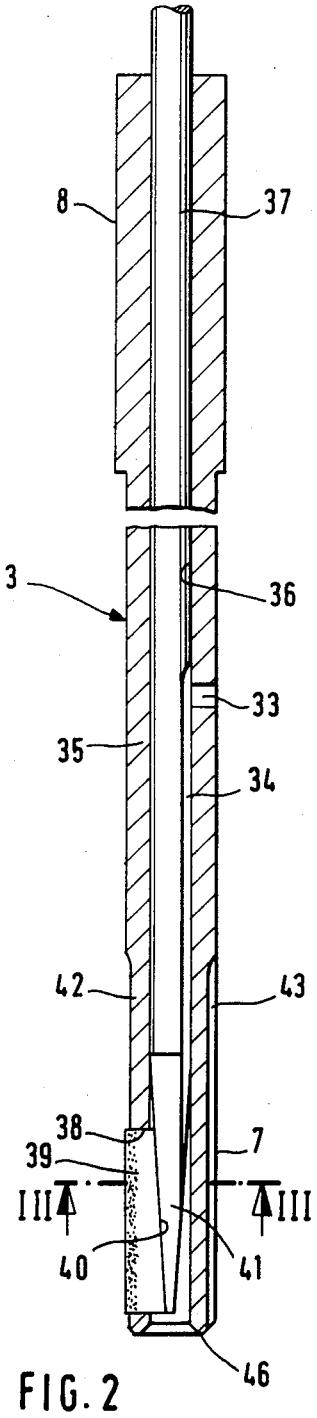
FIG. 2 is a longitudinal section view of a honing tool of the honing device according to FIG. 1, taken on line II—II of FIG. 3.
Figure 3:
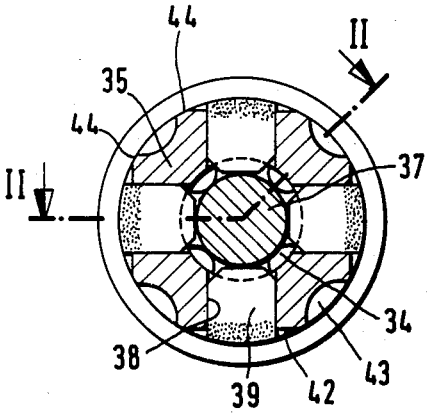
FIG. 3 is a sectional view taken along line III—III of FIG. 2.

As shown especially in FIGS. 2 and 3, the tool shank 35 is provided with an axial passage bore 36, in which a spreader rod 37 is guided. In the front region 7 of the tool shank 35, there are preferably four slots 38 which resemble oblong holes and which each receive a honing strip 39 with an abrasive covering. The dimensions and shape of the honing strip 39 are such that they can be moved radially in the slots 38 with only very slight play. For this purpose, the honing strips have an inner wedge surface 40 which extends in the longitudinal direction and which interacts with the conical portion 41 of the spreader rod 37. The spreader rod 37 also has grooves 34 which start somewhat above the bores 33 of the tool shank 35 and which extend towards the portion 41. The grooves 34 form coolant ducts, via which the coolant flows under high pressure, inside the bore 36, to the free front end 46 of the tool shank 35, this end 46 penetrating into the blind-hole bore 2 during machining. As shown in FIG. 3, the grooves 34 are rounded, preferably in the form of a part circle.

On the outer periphery of the tool shank 35, in the region of the honing strips 39, there are preferably several axially extending flattened portions 42 arranged at equal peripheral distances from one another. Moreover, between the honing strips there are axially extending grooves 43 (FIG. 3) which are preferably likewise arranged at equal peripheral distances from one another and which serve for removing the coolant from the work zone. The length of the grooves 43 is such that, in the lower stroke end position of the honing tool, they extend from the bottom end 46 of the honing tool 3 to a point somewhat above a workpiece top edge 1*a* (FIG. 1).

The flattened portions 42 and the grooves 43 constitute a return duct and are arranged in such a way that between them there are respective guide webs 44 formed by portions of the outer surface of the tool shank 35. The grooves 43 are rounded so as to have a cross section in the form of a part circle (FIG. 3).

The honing tool 3 is made at least partially of an especially wear-resistant material, in order to lengthen its service life. It is preferably produced in one piece from hard metal.

Before the start of honing, the machine spindle 9 is in its upper end position, the honing tool 3 together with its honing strips 39 being axially located completely within the bore 27 of the guide part 14 (this position is not shown). The coolant feed device 5 is likewise held in an upper end position (see the dot-and-dash lines in FIG. 1) within the guide bush 11 by means of its housing part 10 via a known lifting appliance (not shown). In this position, the workpiece holder 4, together with the workpiece 1, is freely movable in the horizontal direction underneath the coolant feed device 5, in order to make it possible to deliver and remove the workpieces 1, for example, by means of a rotary indexing table. As soon as a workpiece is positioned underneath the honing tool 3, the coolant feed device 5 is lowered until the end portion 19 of the guide part 14 comes near the workpiece top edge 1*a*, and the honing tool 3, together with its honing strips 39, is then moved into the blind-hole bore 2 by the machine spindle 9. At the same time, the gimbal-mounted workpiece 1 is aligned with the honing tool 3 clamped rigidly in the machine spindle 9 (FIG. 1). The advance of the honing strips and the rotary and lifting movement of the honing tool are then switched on, and at the same time coolant is supplied via the line 32. The coolant enters the annular chamber 22 under high pressure, preferably under a pressure of approximately 20 to 30 bar, and presses the guide part 14 by means of its flange surface 17 against the bottom 18 of the cylindrical bore 13. The sealing part 15 is also pressed against the cover 24 by means of its flange 23. These two parts, which hitherto have been able to float freely relative to the honing tool, are consequently held fast and give the honing tool additional guidance. At the same time, the annular chamber 22 is sealed off from the outside. The coolant enters the distributor chamber 29 via the bores 30 and circulates around the tool shank 35. The restricted play between the tool shank and the bore 28 of the sealing part 15 and the bore 27 of the guide part 14, in conjunction with the high coolant pressure, ensure hydrostatic guidance and sealing on the moving honing tool 3. At the same time, the coolant enters the interior of the honing tool 3 via the further radial bores 33 and flows, within the bore 36, in the axial grooves 43 in the spreader rod 37 to the end 46 of the honing tool 3. There, the coolant comes out directly in the region of the bottom of the blind-hole bore 2. The coolant then necessarily has to flow off from the blind-hole bore 2 via the flattened portions 42 made in the outer periphery of the honing tool 3 and via the grooves 43. At the same time, the entire work zone of the blind-hole bore 2 is thoroughly flushed, and effective cooling and reliable removal of abraded particles are guaranteed. Furthermore, the high coolant pressure, in conjunction with the special mounting and arrangement of the coolant feed device, results in a vibration-damping stiffening of the system comprising the honing tool and workpiece, thus contributing to extremely high machining accuracy and a considerable lengthening of the service life.

When the honing tool 3 is moved out of the blind-hole bore 2 after the honing operation has ended, the honing strips 39 are received immediately by the bore 27 of the guide part 14 again and are held unreleasably. For this purpose, the mouth of the bore 27 facing the workpiece 1 has a funnelshaped widened portion 45 which makes it easier to introduce the honing strips 39.

What is claimed is:

1. A honing device for the precision machining of small bores in workpieces comprising:

(a) a honing tool including a shank having at least one work zone equipped with radially expandible abrasive covering means for machining the workpiece, (b) a coolant duct system formed in said tool for feeding coolant under pressure to the work zone, said system including at least one longitudinally extending groove for supplying coolant to the end face of the tool adjacent the work zone, and at least one return duct extending along the outer periphery of said tool for removing the coolant and removed metal from the work zone, and (c) a coolant feed device, including coolant supply means, for supplying coolant under pressure to said duct system, said device being aligned with and closely guiding said shank of said tool when coolant is supplied under pressure to said at least one groove and thus to the work zone.

2. A device as claimed in claim 1, wherein the coolant duct system comprises a plurality of peripheral grooves formed in a spreader device mounted within said tool shank, said peripheral grooves being arranged at equal peripheral distances from one another.

3. A device as claimed in claim 1, wherein the coolant is fed under a high pressure of between 20 and 30 bars.

4. A device as claimed in claim 2, wherein said coolant duct system extends from a lower end portion of the spreader device to a point above approximately radial bores formed in the tool shank.

5. A device as claimed in claim 1, wherein a plurality of return ducts are provided, formed by flattened portions and return grooves on the outside of the tool shank.

6. A device as claimed in claim 5, wherein, in the lowest stroke position of the honing tool in the working position, the return ducts extend from the bottom end of the workpiece to a point above the workpiece.

7. A device as claimed in claim 5, wherein said honing tool has guide webs between the flattened portions and the return grooves.

8. A device as claimed in claim 4, wherein said tool shank is formed with radial bores which open into the coolant duct system.

9. A device as claimed in claim 8, wherein the bores in the tool shank open into a distributor chamber surrounding the outer surface of the tool shank and above a passage bore in a guide part of said coolant feed device.

10. A device as claimed in claim 9, wherein approximately radial bores in the guide part open into said distributor chamber.

11. A device as claimed in claim 10, wherein there are several sets of radial bores, each set comprising several individual bores arranged at equal peripheral distances from one another.

12. A device as claimed in claim 11, wherein the radial bores in the guide part open into an annular chamber radially outwardly of the distributor chamber, said annular chamber being arranged between an end portion of the guide part containing said bores, and a cylindrical bore of a housing part of said coolant feed device.

13. A device as claimed in claim 12, wherein the annular chamber is limited in the axial direction by an upper sealing part and a center portion of widened diameter of the guide part, and wherein the guide part and the sealing part are arranged so as to float with radial play in the cylindrical bore of the housing part.

14. A device as claimed in claim 12, wherein a connecting bore in the housing part opens into said annular chamber and communicates with a coolant feed line which supplies coolant under pressure.

15. A device as claimed in claim 13, wherein the housing part is arranged so as to be axially displaceable in a guide bush of the coolant feed device.

16. A device as claimed in claim 13, wherein during the machining of the workpiece, the sealing part and the center portion of the guide part rest against the housing part sealingly over their entire surface, and wherein the sealing part rests against a cover which is fastened in a widened bore portion of the cylindrical bore of the housing part.

17. A device as claimed in claim 13, wherein the center portion of the guide part rests on a bottom wall of the housing part.

18. A device as claimed in claim 16, wherein said bottom wall and said cover have central bores aligned with one another, said sealing part and said guide part being provided with narrowed end portions which project through said central bores.

19. A device as claimed in claim 18, wherein said central bores are concentric, with the tool shank projecting through said central bores with slight play, and wherein the bore in the guide part widens at the free end of the narrowed end portion.

* * * * *